US011022919B2

(12) United States Patent
Kato

(10) Patent No.: US 11,022,919 B2
(45) Date of Patent: Jun. 1, 2021

(54) POWER CONTROL FOR HEATING DEVICE, FIXING DEVICE, AND IMAGE FORMING APPARATUS

(71) Applicant: FUJI XEROX CO., LTD., Tokyo (JP)

(72) Inventor: Yasuhiro Kato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/744,348

(22) Filed: Jan. 16, 2020

(65) Prior Publication Data

US 2021/0072677 A1 Mar. 11, 2021

(30) Foreign Application Priority Data

Sep. 11, 2019 (JP) ..... JP2019-165287

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01)

(58) Field of Classification Search
CPC ..... G03G 15/2039; G03G 15/80
USPC ..... 399/67
See application file for complete search history.

(56) References Cited

U.S. PATENT DOCUMENTS 9,651,903 B2 5/2017 Shiki et al.
2016/0357135 A1* 12/2016 Yamamoto ..... G03G 15/2032

FOREIGN PATENT DOCUMENTS

JP 2015-219461 A 12/2015
JP 2018-189718 A 11/2018

* cited by examiner

*Primary Examiner* — Q Grainger
(74) *Attorney, Agent, or Firm* — Sughrue Mion, PLLC

(57) ABSTRACT

A heating device includes at least one heat-generating member that generates heat by being supplied with power supplied by a shared power source and a controller that performs control in such a manner that, when the shared power source starts supplying power to the heat-generating member, a rated power is supplied to the heat-generating member after power that is 33% output or 67% output of the rated power has been supplied to the heat-generating member.

19 Claims, 10 Drawing Sheets

POWER CONTROL FOR HEATING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2019-165287 filed Sep. 11, 2019.

BACKGROUND

(i) Technical Field

The present disclosure relates to a heating device, a fixing device, and an image forming apparatus.

(ii) Related Art

Japanese Unexamined Patent Application Publication No. 2015-219461 discloses a fixing device that includes a plurality of heaters that fix an image onto a sheet, a switching unit that switches between an ON state in which the plurality of heaters are connected to an alternating-current (AC) power source and an OFF state in which the plurality of heaters are disconnected from the AC power source, and a controller that controls turning on and off of the plurality of heaters by causing the switching unit to perform its switching operation in accordance with a turn on/off pattern in units of a half-wave cycle of the AC power source. When switching the turn on/off pattern, the controller sets a control cycle that is a switching period of the turn on/off pattern to be longer than a first period of time that does not affect a flicker value and to be shorter than a second period of time that does not affect temperature control responsivity or selects, as the above turn on/off pattern, a third turn on/off pattern with which the power difference between a first turn on/off pattern, which is an old pattern, and a second turn on/off pattern, which is a new pattern, is smaller than a predetermined reference power difference.

SUMMARY

Aspects of non-limiting embodiments of the present disclosure relate to providing a heating device, a fixing device, and an image forming apparatus capable of, when a shared power source that supplies power to the heating device also supplies power to another device, reducing a probability that the power supplied to the other device will be brought into a flickering state compared with the configuration in which a rated power is supplied from an early period of supply of power to the heat-generating member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a heating device including at least one heat-generating member that generates heat by being supplied with power supplied by a shared power source and a controller that performs control in such a manner that, when the shared power source starts supplying power to the heat-generating member, a rated power is supplied to the heat-generating member after power that is 33% output or 67% output of the rated power has been supplied to the heat-generating member.

BRIEF DESCRIPTION OF THE DRAWINGS

Exemplary embodiments of the present disclosure will be described in detail based on the following figures, wherein.

DETAILED DESCRIPTION

First Exemplary Embodiment

An image forming apparatus 20 and a fixing device 30 according to a first exemplary embodiment will be described as an example of an image forming apparatus and an example of a fixing device.

[Overall Configuration]

Figure 1:
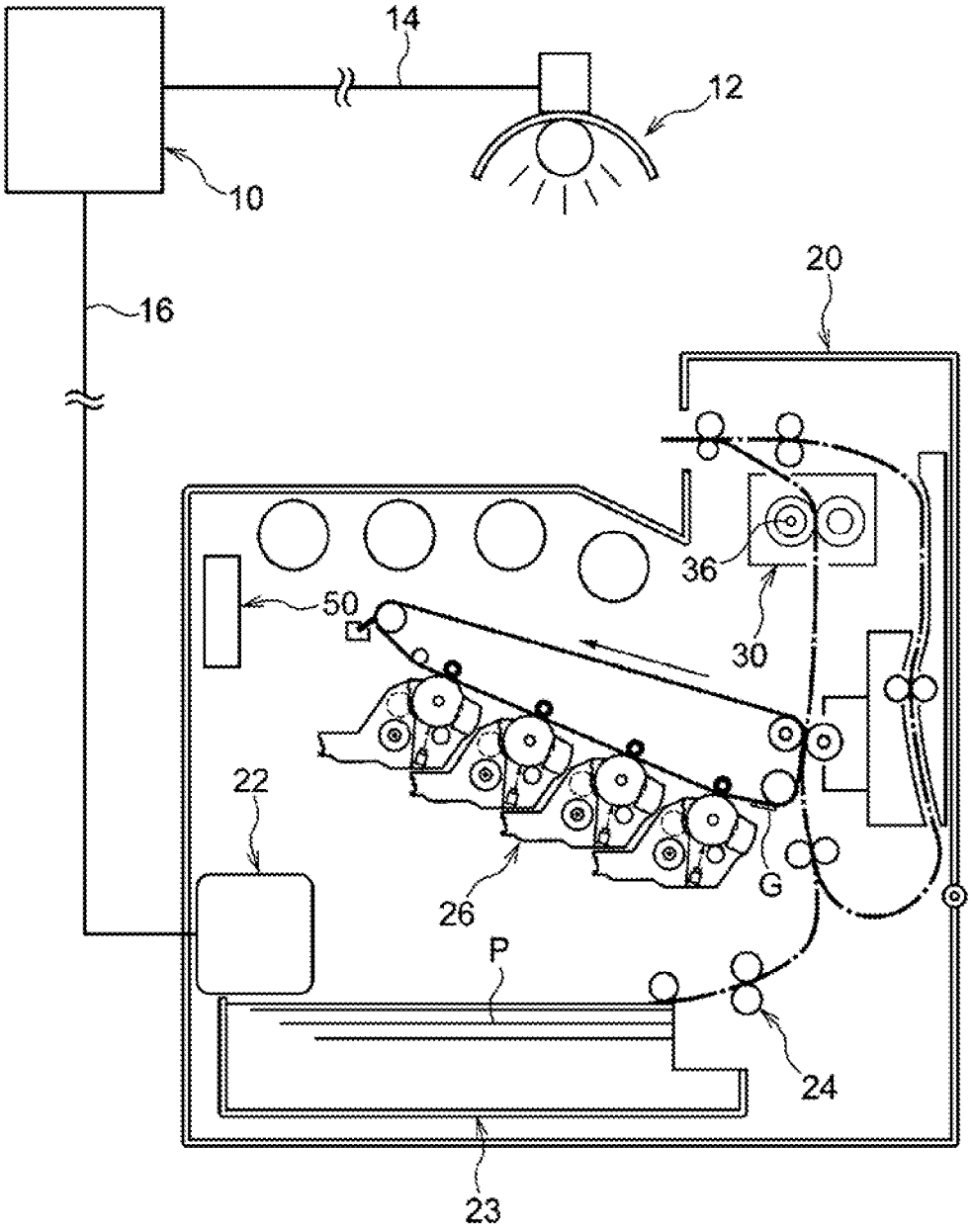
FIG. 1 is a front view of an image forming apparatus according to a first exemplary embodiment.

FIG. 1 illustrates a distribution switchboard 10, an interior lighting 12, and the image forming apparatus 20. The distribution switchboard 10 and the interior lighting 12 are connected to each other by a wiring line 14. The distribution switchboard 10 and the image forming apparatus 20 are connected to each other by a wiring line 16. The distribution switchboard 10 supplies power that is supplied by a system power source (e.g., a commercial power source provided by an electric-power company) to the interior lighting 12 and the image forming apparatus 20. Note that the distribution switchboard 10 is an example of a shared power source. As an example, the power supplied by the distribution switchboard 10 is alternating-current (AC) power.

The interior lighting 12 is an example of an apparatus that is different from the image forming apparatus 20. The interior lighting 12 lights up by being supplied with power that is at least smaller than the power supplied to the image forming apparatus 20 when a fixing operation is performed. Note that, when the image forming apparatus 20 is activated (here, when the fixing device 30 that will be described later starts operating), the interior lighting 12 may sometimes shine unsteadily (the brightness of the interior lighting 12 may sometimes repeatedly change in a short time). This is because a large current flows to the side of the image forming apparatus 20 when the fixing device 30 starts operating, so that a voltage drop occurs in the distribution switchboard 10, and the voltage on the side of the interior lighting 12 decreases. This "unsteady shining" will hereinafter be referred to as "flicker".

An index that indicates the degree of flicker is "flicker value". A flicker value (Pst) in the first exemplary embodiment refers to a value measured by a measurement method based on the flicker standard (IEC 61000-3-11). In the first exemplary embodiment, Pst is set to 1.0 as a standard flicker value.

<Image Forming Apparatus>

The image forming apparatus 20 includes an image forming unit 26 that forms a toner image G onto one of sheets P and the fixing device 30. More specifically, the image forming apparatus 20 includes a power source 22 to which power is supplied by the distribution switchboard 10, an accommodating unit 23 that accommodates the sheets P, a transport unit 24 that transports the sheets P, the image forming unit 26, and the fixing device 30. Each of the sheets P is an example of a recording medium. The toner image G is an example of a developer image.

Figure 3:
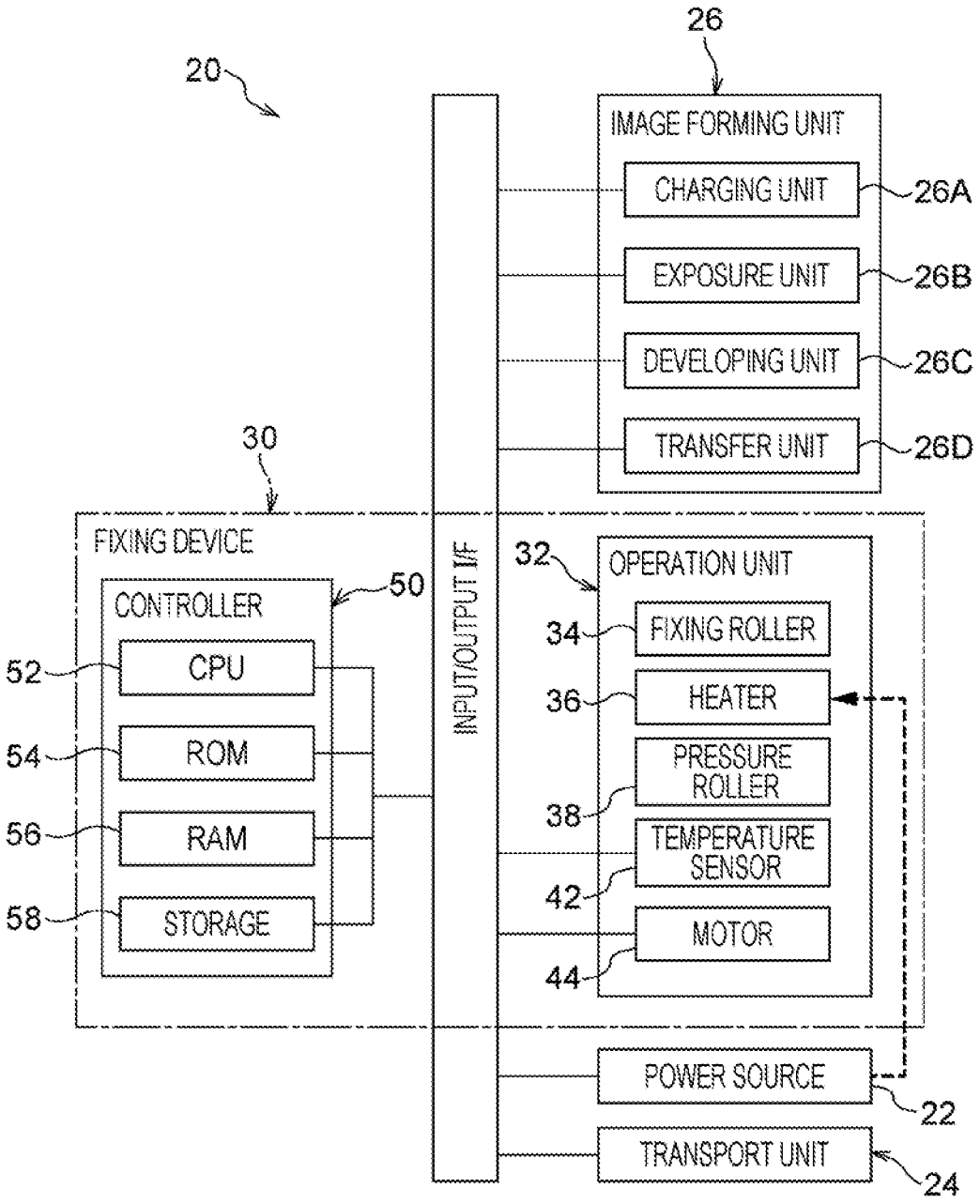
FIG. 3 is a block diagram illustrating a configuration of the fixing device according to the first exemplary embodiment.

The image forming unit 26 illustrated in FIG. 3 is an example of an image forming unit. The image forming unit 26 includes a charging unit 26A that charges the outer peripheral surface of a photoconductor (not illustrated), an exposure unit 26B that exposes the charged outer peripheral surface to light so as to form a latent image, a developing unit 26C that develops the latent image with toner, and a transfer unit 26D that transfers the developed toner image G onto one of the sheets P.

[Configuration of Principal Portion]

The fixing device 30 will now be described.

Figure 2:
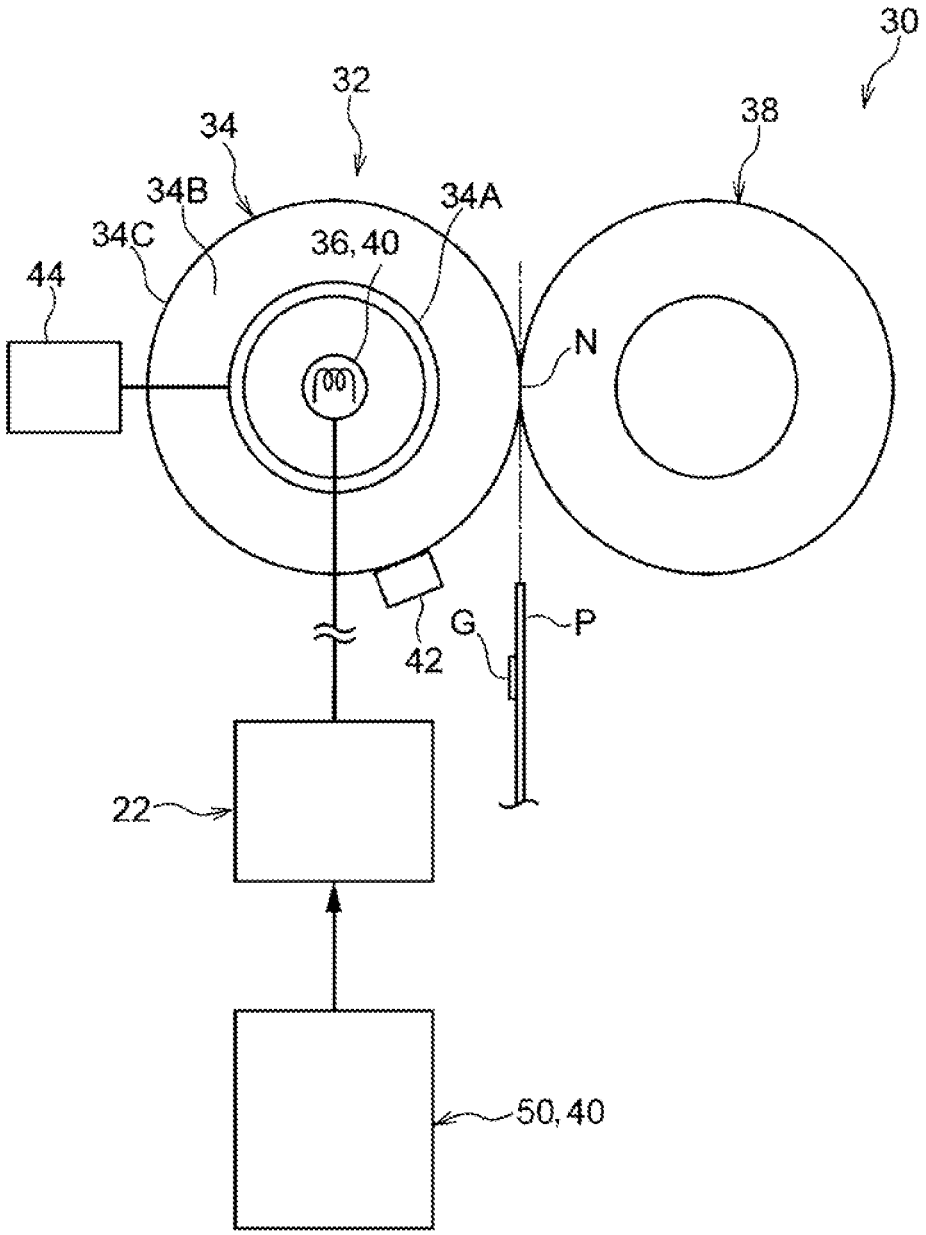
FIG. 2 is a schematic diagram of a fixing device according to each of the first, second, and third exemplary embodiments.

The fixing device 30 illustrated in FIG. 2 includes an operation unit 32 that performs a fixing operation and a controller 50 that controls each operation of the operation unit 32.

<Operation Unit>

As an example, the operation unit 32 includes a fixing roller 34, which is an example of a fixing member, a heater 36, which is an example of a heat-generating member, a pressure roller 38, which is an example of a pressing member, a temperature sensor 42 that detects the temperature of the fixing roller 34, and a motor 44 that causes the fixing roller 34 to rotate. Note that the heater 36 and the controller 50 are included in a heating device 40.

The fixing roller 34 includes a cylindrical shaft portion 34A, an elastic layer 34B, and a release layer 34C. The heater 36 is inserted in the shaft portion 34A. The fixing roller 34 and the pressure roller 38 form a nip part N. The fixing roller 34 and the pressure roller 38 are caused to rotate by the motor 44, so that one of the sheets P is transported. The toner image G is heated and pressurized at the nip part N by the fixing roller 34 that has been heated by the heater 36 and the pressure roller 38, so that the toner image G is fixed onto the sheet P, which has been transported.

As an example, the heater 36 is formed as a halogen lamp that is long in one direction and generates heat by being supplied with power. In addition, the heater 36 is electrically connected to the power source 22. Furthermore, the heater 36 generates heat by being supplied with the power supplied by the power source 22 (the distribution switchboard 10, see FIG. 1) so as to heat the fixing roller 34 in such a manner that the toner image G is fixed onto one of the sheets P.

<Controller>

As an example, the controller 50 illustrated in FIG. 3 is configured to also function as a main controller that controls the operation of each unit of the image forming apparatus 20. Note that the controller 50 may be configured as a discrete controller for the fixing device 30.

The controller 50 includes a central processing unit (CPU) 52, read only memory (ROM) 54, random access memory (RAM) 56, and a storage 58. The units included in the controller 50 are connected to one another via a bus. The ROM 54 stores various programs and various data items. The RAM 56 serves as a work area and temporarily stores a program or a data item. The storage 58 stores various programs including an operating system and various data items. The CPU 52 runs various programs recorded in the ROM 54 or the storage 58.

When supply of power to the heater 36 is started by the power source 22 (the distribution switchboard 10, see FIG. 1), the controller 50 performs control in such a manner that power that is 33% output of a rated power WA (see FIG. 4) is supplied to the heater 36, after which the rated power WA is supplied to the heater 36. Note that the arrow in FIG. 3 that extends from the power source 22 to the heater 36 indicates the supply of power. In the first exemplary embodiment, the rated power WA is power that is necessary for the temperature of the heater 36 to reach a temperature T5 (see FIG. 5) within a predetermined period of time (within a predetermined range). The reason why the power that is 33% output of the rated power WA is supplied to the heater 36 will be described later.

The controller 50 performs "half-wave control" for controlling AC power (power having an AC waveform) that is supplied to the heater 36 by the distribution switchboard 10 (see FIG. 1) in units of a half-wavelength (a half of one wavelength) of the AC power. The half-wave control is an example of thinning-out control, which will be described later. Note that, in the following description, the power (AC power) that is supplied to the heater 36 will hereinafter be referred to as "control power".

The thinning-out control is control for thinning out the AC power that is supplied to a heat-generating member (the heater 36) with respect to the rated power WA by maintaining the amplitude of the AC power as the rated power WA and by changing a period during which power is supplied to the heat-generating member in a period within one cycle of the AC power.

Figure 6:
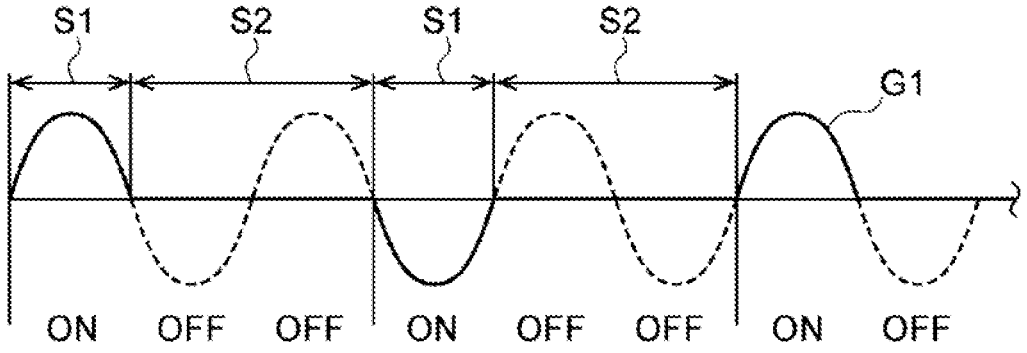
FIG. 6 is a diagram illustrating a turn on/off pattern of the heater in the fixing device according to the first exemplary embodiment.

In FIG. 6, a graph G1 of an AC waveform representing a turn on/off pattern of the heater 36 is illustrated as an example of control of supplying power to the heater 36 (see FIG. 2), the control being performed by the controller 50 (see FIG. 2). Note that the graph G1 is indicated by a bold solid line. The dashed line indicates a state in which the heater 36 is temporarily turned off (the amplitude is zero).

In the graph G1, with a half-wavelength as a unit, 0.5 cycle out of 1.5 cycles is set to be a supply period S1, and the remaining 1.0 cycle is set to be a non-supply period S2, so that control with 33% output is performed. As seen from the graph G1, here, as an example, a power supply pattern in which supply of power is performed (ON) in the first 0.5 cycle out of the 1.5 cycles and in which the supply of power is not performed (OFF) in the subsequent 1.0 cycle is repeated.

[Singular Points of Control Power]

Singular points of the control power when power is supplied to the heater 36 according to the first exemplary embodiment will now be described.

Figure 4:
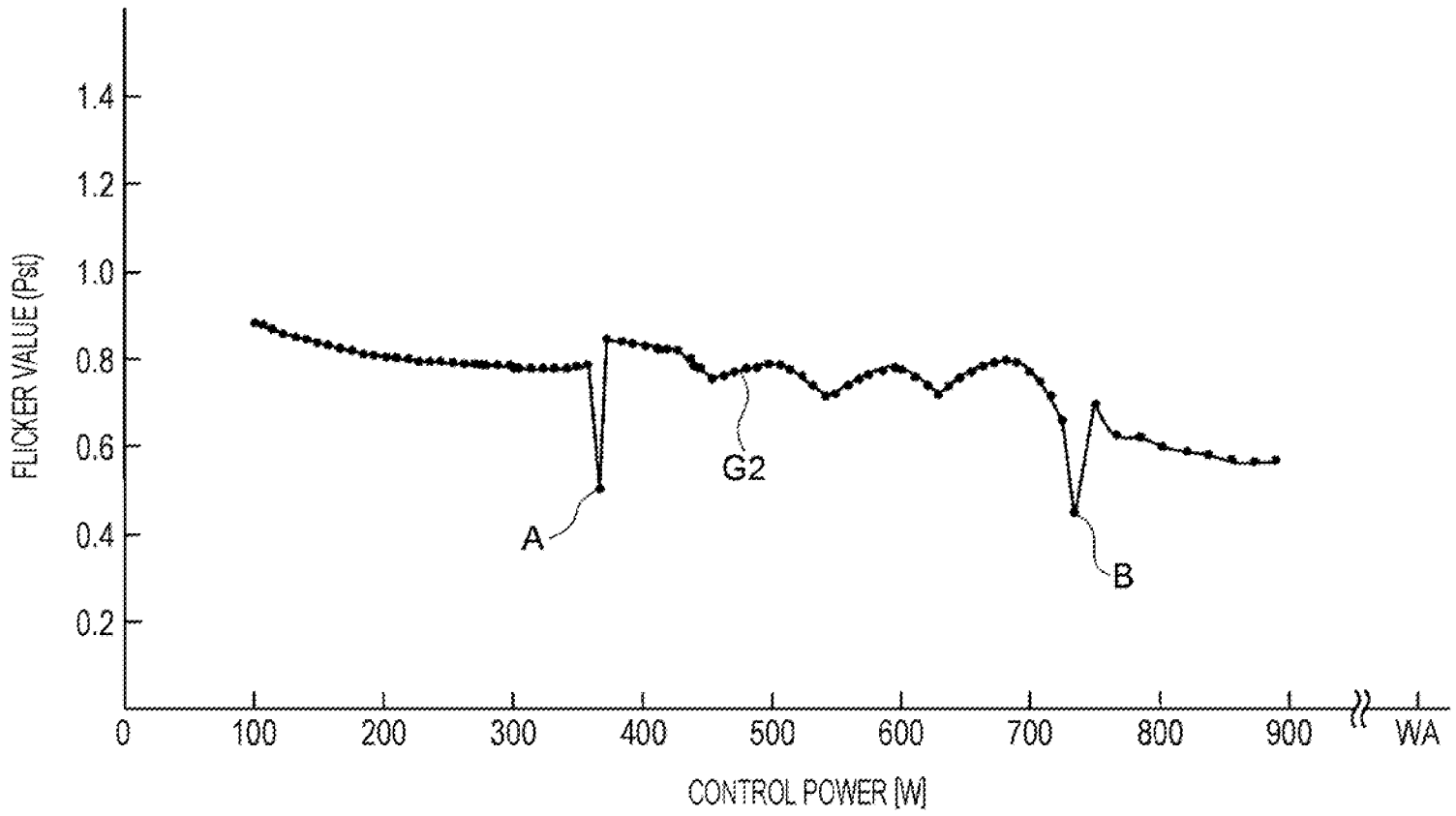
FIG. 4 is a graph illustrating the relationship between control power and flicker value in the fixing device according to each of the first and second exemplary embodiments.

FIG. 4 illustrates a graph G2 illustrating a relationship between the control power [W] supplied to the heater 36 (see FIG. 2) and the flicker value of the interior lighting 12 (see FIG. 1) when the control power is supplied thereto. Each point in the graph G2 is a flicker value that is measured when the heater 36 is activated at a set turn on/off duty ratio. In other words, the graph G2 is obtained by measuring the flicker value while changing the setting of the turn on/off duty ratio. As illustrated in the graph G2, it is confirmed that a singular point A and a singular point B at each of which the flicker value is sharply decreased appear when the control power (the setting of the turn on/off duty ratio) is varied.

Here, it is found that, when the above-mentioned rated power WA [W] is 100%, the control power [W] at the singular point A is equivalent to 33%. It is found that, when the above-mentioned rated power WA [W] is 100%, the control power [W] at the singular point B is equivalent to 67%. It is confirmed that, by setting the control power supplied to the heater 36 to at least one of 33% and 67% as mentioned above, the flicker value decreases more than that in the case of using the control power that is set to neither 33% nor 67%. Note that a measurement error of the control power is set within a range of ±1%.

In other words, it is confirmed that the flicker value decreases as a result of thinning out (reducing) the control power supplied to the heater 36 to 33% or 67% of the rated power WA. Accordingly, in the fixing device 30 (see FIG. 2) according to the first exemplary embodiment, as an example, control power that is 33% output of the rated power WA is supplied to the heater 36 in an early period of printing (from time tc to time te, see FIG. 5) in which flicker occurs. The period from time tc to time te is about 1 second as an example. The rated power WA is set to be supplied to the heater 36 after the early period of printing.

[Temperature of Heater]

A set temperature and a detected temperature of the heater 36 according to the first exemplary embodiment will now be described.

Figure 5:
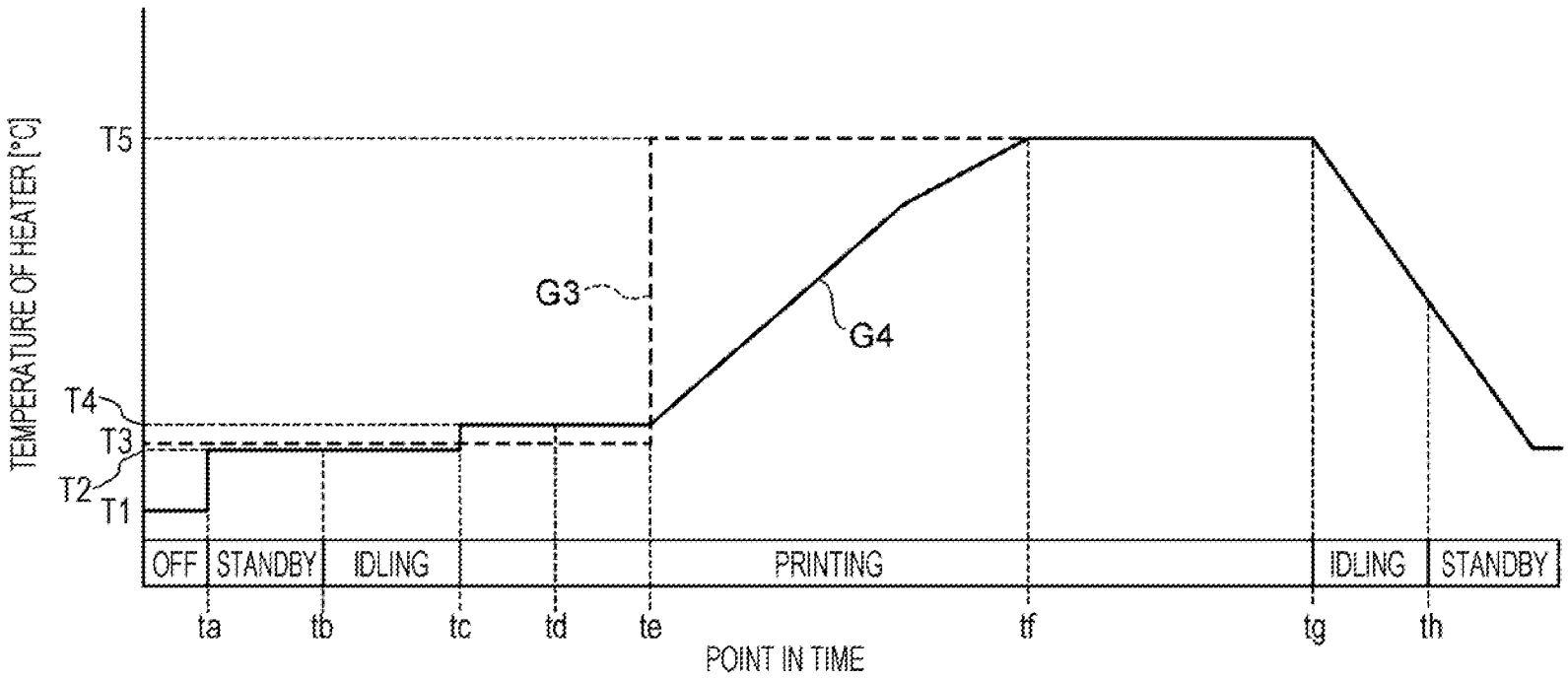
FIG. 5 is a timing chart illustrating changes in the temperature of a heater in the fixing device according to the first exemplary embodiment.

FIG. 5 illustrates a graph G3 of a set temperature of the heater 36 (see FIG. 2) at each point in time, the set temperature having been set in advance in the controller 50 (see FIG. 2), and a graph G4 of the detected temperature of the heater 36 detected by the temperature sensor 42 (see FIG. 2). The graph G3 is indicated by a dashed line. The graph G4 is indicated by a solid line. In FIG. 5, temperatures T1, T2, T3, T4, and T5 [° C.] of the heater 36 are illustrated. The temperature T1 is the lowest temperature, followed by the temperature T2, the temperature T3, the temperature T4, and the temperature T5 in ascending order. Note that temperature differences between the temperatures T1, T2, T3, T4, and T5 of the heater 36, which are illustrated in FIG. 5, do not represent the absolute values of the actual temperature differences.

A period before time ta is a non-operating period during which the fixing device 30 is in an OFF state. A period from time ta to time tb is a first standby period of the fixing device 30. A period from time tb to time tc is a first idling period of the fixing roller 34 and the pressure roller 38 (see FIG. 2). A period from time tc to time tg (including time td, time te, and time tf) is a printing (fixing operation) period. A period from time tg to time th is a second idling period of the fixing roller 34 and the pressure roller 38. A period after time th until the image forming apparatus 20 (see FIG. 1) is brought into an OFF state is a second standby period of the fixing device 30.

As illustrated in the graph G3, in the non-operating period, the first standby period, the first idling period, and the early period of printing, which is the period from time tc to time te, the set temperature of the heater 36 is set to the temperature T3. In a printing period from time te to time tg, the set temperature of the heater 36 is set to the temperature T5, which is as an example of a target temperature. In the early period of printing, the turn on/off pattern of the heater 36 is changed from a normal turn on/off pattern as will be described later.

As illustrated in the graph G4, the detected temperature of the heater 36 is the temperature T1 in the non-operating period (OFF). The detected temperature of the heater 36 is the temperature T2 in the first standby period and the first idling period (from time to to time tc). The detected temperature of the heater 36 is the temperature T4 in the early period of printing. The detected temperature of the heater 36 increases from time te to time tf and is the temperature T5 in a later period of printing that is a period from time tf to time tg. After time tg, the detected temperature of the heater 36 decreases from the temperature T5.

Here, in the fixing device 30 according to the first exemplary embodiment, the controller 50 is set to perform control such that the above-mentioned power supply pattern (see FIG. 6) in which the output is 33% of the rated power WA is repeated in the early period of printing (from time tc to time te).

Comparative Example

As a comparative example of the fixing device 30 according to the first exemplary embodiment, the control power supplied to the heater 36 is set to the rated power WA from the early period of printing, and in this case, it is confirmed that a flicker phenomenon (unsteady shining) occurs in the interior lighting 12.

[Effects]

Effects of the first exemplary embodiment will now be described.

Assume that a main power switch (not illustrated) of the image forming apparatus 20 illustrated in FIG. 1 is in an ON state and that the interior lighting 12 is in a lit-up state. In this state, assume that an image forming process is started. In the fixing device 30, in the first standby period and the first idling period (see FIG. 5), the control power that causes the temperature of the heater 36 to increase to the temperature T2 is supplied to the heater 36. The control power supplied to the heater 36 during these periods is smaller than the rated power WA. Thus, the flicker phenomenon rarely occurs in the interior lighting 12.

Next, in the early period of printing, the controller 50 causes the control power that is 33% output of the rated power WA to be supplied to the heater 36. Here, 33% output of the rated power WA is one of the singular points as mentioned above, and the degree of decrease in the flicker value of the interior lighting 12 is higher than that in the case where the control power that is not 33% output of the rated power WA is supplied. As a result, a voltage drop is less likely to occur in the distribution switchboard 10, and thus, the probability that the power supplied to the interior lighting 12 will be brought into a flickering state is reduced compared with the configuration in which the rated power WA is supplied to the heater 36 from an early period of supply of power to the heater 36.

In addition, in the fixing device 30, the controller 50 performs the half-wave control on the AC power that is supplied to the heater 36. More specifically, when the control power is supplied to the heater 36, the controller 50 makes the control power smaller than the rated power WA by performing the half-wave control with ON/OFF switching in units of a half-wavelength of the AC power (the thinning-out control for reducing the output with respect to the rated power WA). As a result, compared with the configuration in which the amplitude of the AC power is changed, a device for changing the amplitude is not necessary, and the control power may easily be reduced, so that the control power that is supplied to the heater 36 may easily be controlled.

Furthermore, in the fixing device 30, 0.5 cycle out of 1.5 cycles is set to be a supply period of the AC power that is supplied to the heater 36, and the remaining 1.0 cycle is set to be a non-supply period of the AC power, so that control (supply) for 33% output is performed. In other words, when performing output control (power supply) of 33%, which is not a nice round figure, it is not necessary to adjust the output level to exactly 33%, and the output may be obtained only by setting 0.5 cycle out of 1.5 cycles to be the supply period. As a result, it becomes easier to control the control power that is supplied to the heater 36 compared with the configuration in which the control power is supplied during a period when zero crossing of the AC waveform does not occur.

According to the image forming apparatus 20, by providing the fixing device 30, a voltage drop is less likely to occur in the distribution switchboard 10 as mentioned above. As a result of a voltage drop being less likely to occur in the distribution switchboard 10, a reduction in the power that is supplied to the image forming apparatus 20 is suppressed. Consequently, compared with the configuration in which the rated power WA is supplied to the heater 36, occurrence of a flickering state in each unit (e.g., the image forming unit 26) excluding the fixing device 30 included in the image forming apparatus 20 is suppressed.

Second Exemplary Embodiment

Next, the image forming apparatus 20 and the fixing device 30 according to a second exemplary embodiment will be described. Note that members and portions that are basically the same as those of the image forming apparatus 20 and the fixing device 30 according to the first exemplary embodiment, which have been described above, will be denoted by the same reference signs as used in the first exemplary embodiment, and descriptions thereof will be omitted. Descriptions of effects that are similar to those of the first exemplary embodiment will also be omitted.

In the fixing device 30 according to the second exemplary embodiment that is illustrated in FIG. 2, the turn on/off pattern of the heater 36 set in the controller 50 is different from that in the first exemplary embodiment. The configuration excluding this turn on/off pattern is similar to that of the first exemplary embodiment.

Figure 7:
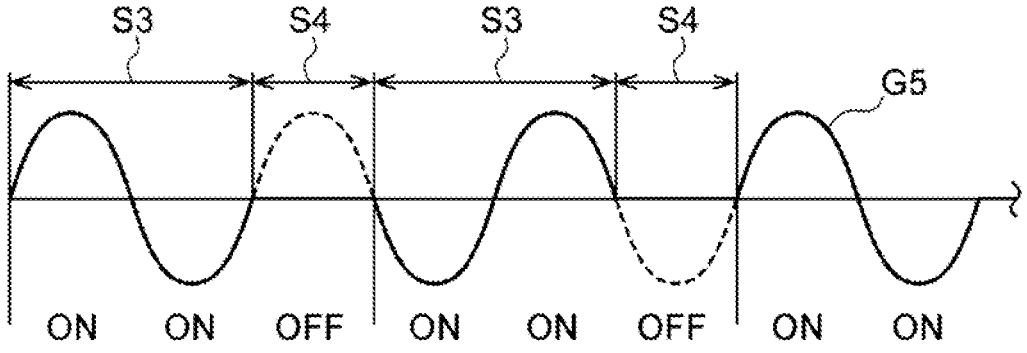
FIG. 7 is a diagram illustrating a turn on/off pattern of a heater in the fixing device according to the second exemplary embodiment.

In FIG. 7, a graph G5 representing a turn on/off pattern of the heater 36 is illustrated as an example of control of supplying power to the heater 36, the control being performed by the controller 50. Note that the graph G5 is indicated by a bold solid line. The dashed line indicates a state in which the heater 36 is turned off (the amplitude is zero).

In the graph G5, with a half-wavelength as a unit, 1.0 cycle out of 1.5 cycles is set to be a supply period S3, and the remaining 0.5 cycle is set to be a non-supply period S4, so that control with 67% output is performed. Here, as an example, a power supply pattern in which supply of power is performed (ON) in the first 1.0 cycle out of the 1.5 cycles and in which the supply of power is not performed (OFF) in the subsequent 0.5 cycle is repeated.

[Effects]

Effects of the second exemplary embodiment will now be described.

In the fixing device 30 according to the second exemplary embodiment, in the early period of printing, the controller 50 causes the control power that is 67% output of the rated power WA to be supplied to the heater 36. Here, 67% output of the rated power WA is one of the singular points as mentioned above, and the degree of decrease in the flicker value of the interior lighting 12 is high. As a result, a voltage drop is less likely to occur in the distribution switchboard 10, and thus, the probability that the power supplied to the interior lighting 12 will be brought into a flickering state is reduced compared with the configuration in which the rated power WA is supplied from the early period of supply of power to the heater 36.

In addition, in the fixing device 30 according to the second exemplary embodiment, 1.0 cycles out of 1.5 cycles is set to be the supply period S3 of the AC power that is supplied to the heater 36, and the remaining 0.5 cycle is set to be the non-supply period S4 of the AC power, so that control (supply) of 67% output is performed. In other words, when performing output control (power supply) of 67%, which is not a nice round figure, it is not necessary to adjust the output level to exactly 67%, and the output may be obtained only by setting 1.0 cycle out of 1.5 cycles to be the supply period. As a result, it becomes easier to control the control power that is supplied to the heater 36 compared with the configuration in which the AC power is supplied during a period when zero crossing of the AC waveform does not occur.

Third Exemplary Embodiment

Next, the image forming apparatus 20 and the fixing device 30 according to a third exemplary embodiment will be described. Note that members and portions that are basically the same as those of the image forming apparatuses 20 and the fixing devices 30 according to the first and second exemplary embodiments, which have been described above, will be denoted by the same reference signs as used in the first and second exemplary embodiments, and descriptions thereof will be omitted. Descriptions of effects that are similar to those of the first and second exemplary embodiments will also be omitted.

In the fixing device 30 according to the third exemplary embodiment that is illustrated in FIG. 2, the turn on/off pattern of the heater 36 set in the controller 50 is different from those in the first and second exemplary embodiments. The configuration excluding this turn on/off pattern is similar to those in the first and second exemplary embodiments.

Figure 8:
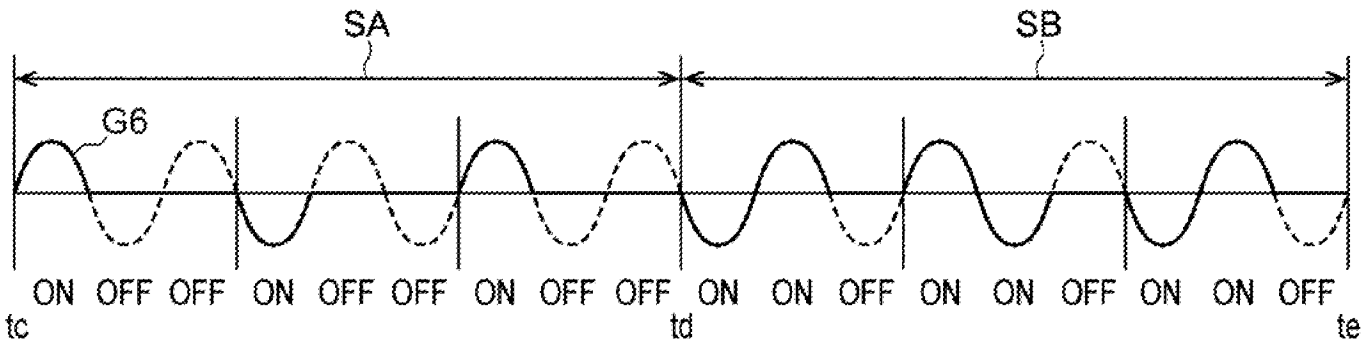
FIG. 8 is a diagram illustrating a turn on/off pattern of a heater in the fixing device according to the third exemplary embodiment.

In FIG. 8, a graph G6 representing a turn on/off pattern of the heater 36 is illustrated as an example of control of supplying power to the heater 36, the control being performed by the controller 50 according to the third exemplary embodiment. Note that the graph G6 is indicated by a bold solid line. The dashed line indicates a state in which the heater 36 is turned off (the amplitude is zero).

As an example, the graph G6 illustrates a state in which control for a first period SA corresponding to 4.5 cycles (from time tc to time td) is performed followed by control for a second period SB corresponding to 4.5 cycles (from time td to time te). In the first period SA, the control with 33% output is performed. In the second period SB, the control with 67% output is performed. Note that each of the first period SA and the second period SB may correspond to any number of cycles that are multiples of 1.5 cycles. In this manner, the controller 50 is configured to control the heater 36. The controller 50 performs control in such a manner that the control power that is 67% output of the rated power WA is supplied to the heater 36 after the control power that is 33% output of the rated power WA has been supplied to the heater 36 and before the rated power WA is supplied to the heater 36.

[Effects]

Effects of the third exemplary embodiment will now be described.

In the fixing device 30 according to the third exemplary embodiment, in the early period of printing, the controller 50 causes the control power that is 33% output or 67% output of the rated power WA to be supplied to the heater 36. Here, 33% output or 67% output of the rated power WA is one of the singular points as mentioned above, and the degree of decrease in the flicker value of the interior lighting 12 is high. As a result, a voltage drop is less likely to occur in the distribution switchboard 10, and thus, the probability that the power supplied to the interior lighting 12 will be brought into a flickering state is reduced compared with the configuration in which the rated power WA is supplied from the early period of supply of power to the heater 36.

In addition, in the fixing device 30 according to the third exemplary embodiment, the control power that is 67% output is supplied to the heater 36 after the control power that is 33% output has been supplied to the heater 36. As a result, the amount of the control power that is supplied to the heater 36 increases more than that in the configuration in which the control power is switched in one step during the period from when supply of power is started until the fixing operation is performed, and thus, the time taken for the temperature of the heater 36 to reach the target temperature is reduced.

Fourth Exemplary Embodiment

Next, the image forming apparatus 20 and a fixing device 60 according to a fourth exemplary embodiment will be described. Note that members and portions that are basically the same as those of the image forming apparatuses 20 and the fixing devices 30 according to the first, second, and third exemplary embodiments, which have been described above, will be denoted by the same reference signs as used in the first, second, and third exemplary embodiments, and descriptions thereof will be omitted. Descriptions of effects that are similar to those of the first, second, and third exemplary embodiments will also be omitted.

Figure 9:
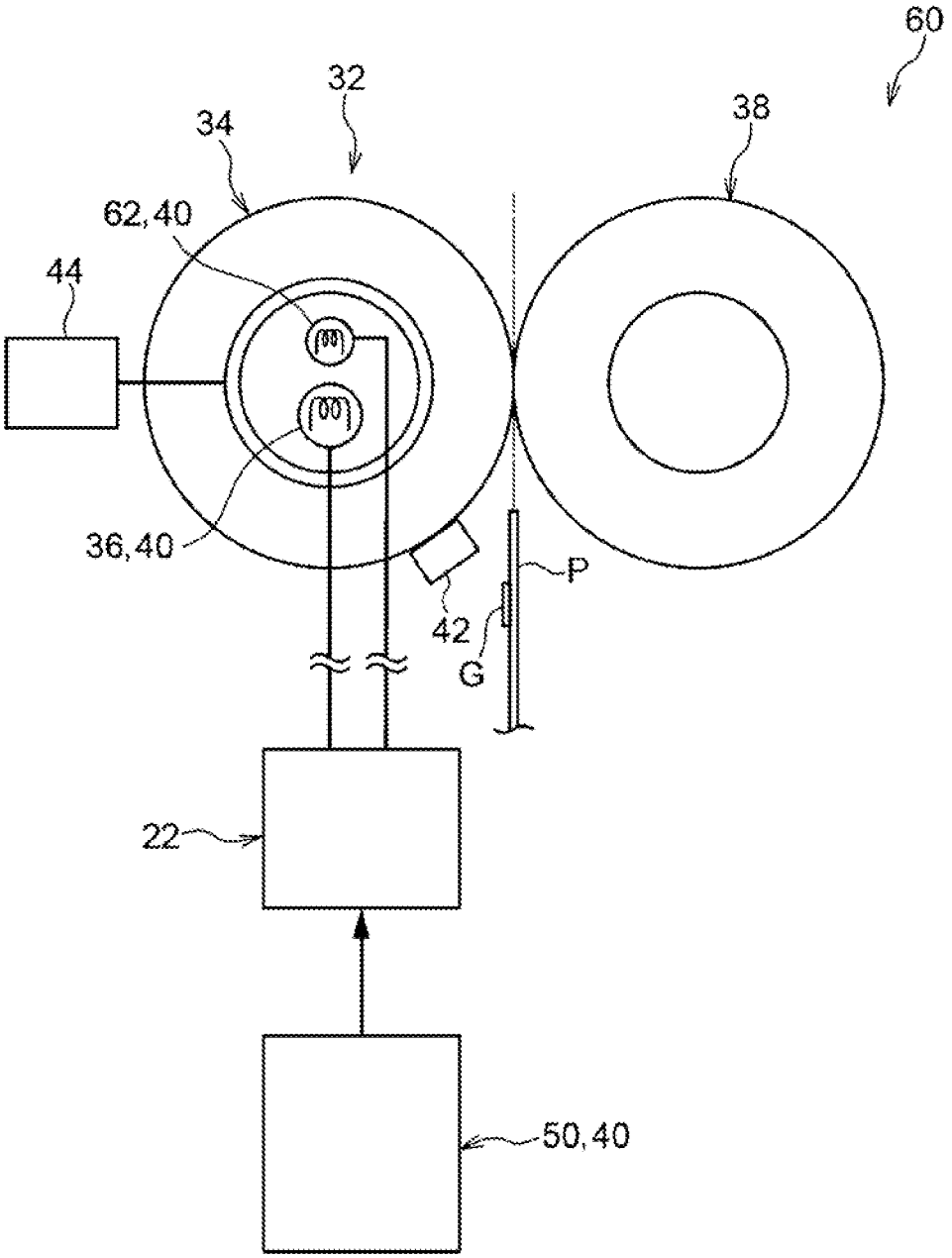
FIG. 9 is a schematic diagram of a fixing device according to a fourth exemplary embodiment.

FIG. 9 illustrates the fixing device 60 according to the fourth exemplary embodiment. The differences between the fixing device 60 and the fixing device 30 (see FIG. 2) according to the third exemplary embodiment are that the fixing device 60 further includes a heater 62, which is another example of a heat-generating member, in addition to the heater 36 and that the turn on/off patterns of the heaters 36 and 62 set in the controller 50 are different from the turn on/off pattern of the fixing device 30 set in the controller 50 in the third exemplary embodiment. In other words, the fixing device 60 includes a plurality of heat-generating members. The controller 50 is configured to control the control power that is supplied to the heater 36 and the heater 62. In addition, the heaters 36 and 62 and the controller 50 are included in the heating device 40.

As an example, the heater 62 is formed as a halogen lamp that is long in one direction and generates heat by being supplied with the control power. In addition, the heater 62 is electrically connected to the power source 22. Furthermore, the heater 62 generates heat by being supplied with the control power supplied by the power source 22 (the distribution switchboard 10, see FIG. 1) so as to heat the fixing roller 34 in such a manner that the toner image G is fixed onto a recording medium. As an example, the output of the heater 62 is lower than the output of the heater 36.

The controller 50 performs control in such a manner that supply of the control power to the heater 36 and supply of the control power to the heater 62 are started at different points in time. More specifically, the controller 50 performs control in such a manner that supply of the control power to the heater 36 that has a larger capacity than the heater 62 is started before supply of the control power to the heater 62 that has a smaller capacity is started. Note that the "capacity" of each of the heaters 36 and 62 refers to the amount of heat [J/s=W] required to raise the temperature of an object to be heated.

Figure 10:
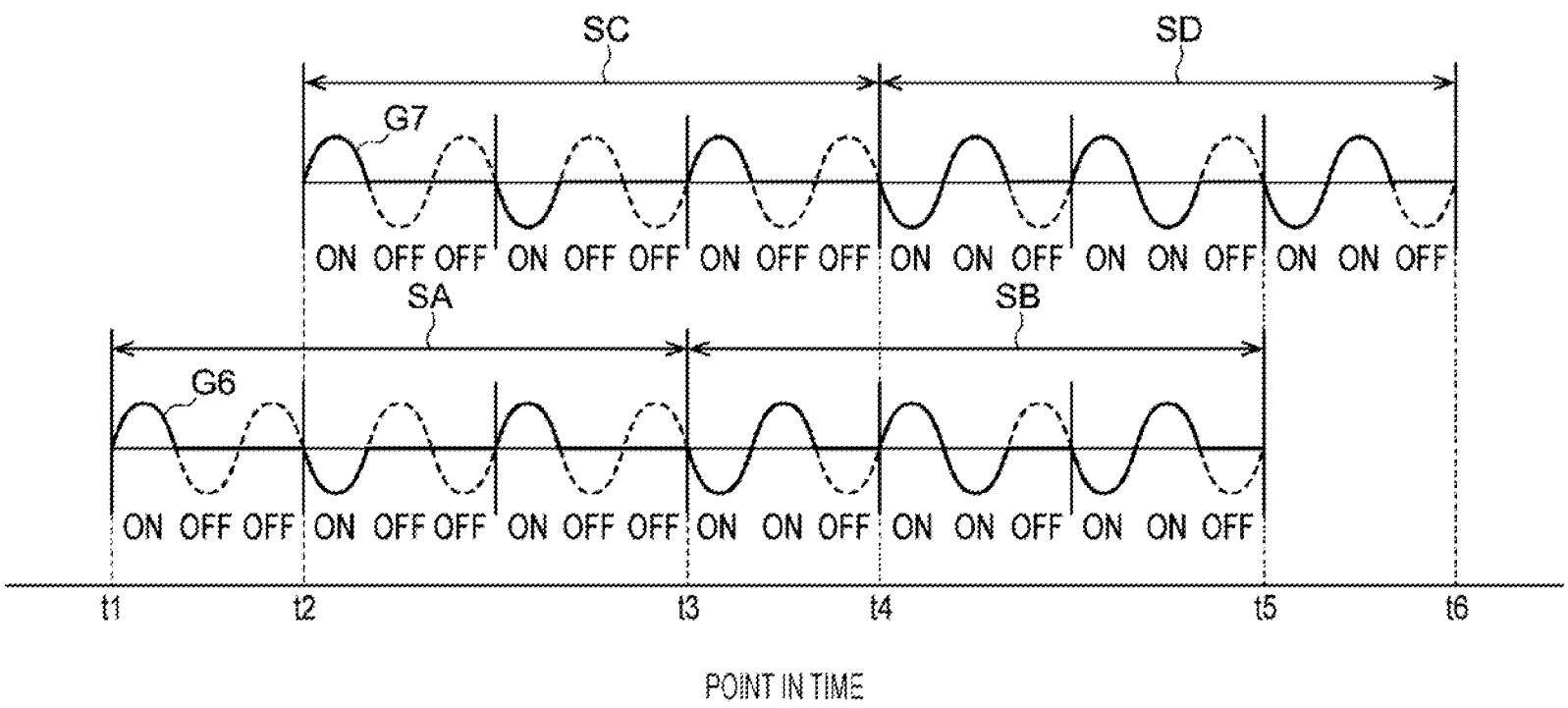
FIG. 10 is a diagram illustrating a turn on/off pattern of a heater in the fixing device according to the fourth exemplary embodiment.

In FIG. 10, a graph G7 illustrating the turn on/off pattern of the heater 62 and a graph G6 illustrating the turn on/off pattern of the heater 36 are respectively illustrated as an example of control of supplying power to the heater 62 and an example of control of supplying power to the heater 36 (see FIG. 9), each of the control being performed by the controller 50 according to the fourth exemplary embodiment. Note that the graph G6 is similar to that of the third exemplary embodiment, and thus, description thereof will be omitted. The graph G7 is indicated by a bold solid line.

As an example, the graph G7 illustrates a state in which control for a first period SC corresponding to 4.5 cycles is performed followed by control for a second period SD corresponding to 4.5 cycles. In the first period SC, the control with 33% output is performed. In the second period SD, the control with 67% output is performed. Note that each of the first period SC and the second period SD may correspond to any number of cycles that are multiples of 1.5 cycles. In this manner, the controller 50 controls the control power that is supplied to the heater 62 in such a manner that the control power that is 67% output of the rated power WA is supplied to the heater 62 after the control power that is 33% output of the rated power WA has been supplied to the heater 62 and before the rated power WA is supplied to the heater 62.

In FIG. 10, time t1 is the start point of the first period SA. Time t2 is a point in time after 1.5 cycles have passed from time t1 and is the start point of the first period SC. Time t3 is the start point of the second period SB and is a point in time after 3.0 cycles have passed from time t2. Time t4 is a point in time after 1.5 cycles have passed from time t3 and is the start point of the second period SD. Time t5 is the end point of the second period SB and is a point in time after 3.0 cycles have passed from time t4. Time t6 is a point in time after 1.5 cycles have passed from time t5 and is the end point of the second period SD. In this manner, the controller 50 performs control in such a manner that supply of the control power to the heater 36 is performed first, and supply of the control power to the heater 62 is performed 1.5 cycles (the period from time t1 to time t2) later.

[Effects]

Effects of the fourth exemplary embodiment will now be described.

The controller 50 of the fixing device 60 illustrated in FIG. 9 causes the control power that is 33% output or 67% output of the rated power WA to be supplied to the heaters 36 and 62 in the early period of printing. Here, 33% output or 67% output of the rated power WA supplied to each of the heaters 36 and 62 is one of the singular points as mentioned above, and the degree of decrease in the flicker value of the interior lighting 12 is high. As a result, a voltage drop is less likely to occur in the distribution switchboard 10, and thus, the probability that the power supplied to the interior lighting 12 will be brought into a flickering state is reduced compared with the configuration in which the rated power WA is supplied from the early period of supply of power to the heaters 36 and 62.

According to the fixing device 60, at least the control power that is supplied to the heater 36, which has a larger capacity than the heater 62, is controlled. As a result, compared with the configuration in which only supply of power to the heater 62 having a smaller capacity is controlled, supply of a large amount of power that affects flicker is managed, and thus, occurrence of the flickering state in the interior lighting 12 is suppressed.

In addition, according to the fixing device 60, time t1, which is a point in time at which supply of the control power to the heater 36 is started, and time t2, which is a point in time at which supply of the control power to the heater 62 is started, differ from each other. As a result, the amount of the control power that is supplied to the fixing device 60 at time t1 is smaller than that in the configuration in which power is simultaneously supplied to the heaters 36 and 62, and thus, occurrence of the flickering state in the interior lighting 12 is suppressed.

Furthermore, according to the fixing device 60, supply of power to the heater 36 having a larger capacity is started before supply of power to the heater 62 having a smaller capacity is started. As a result, a relatively large amount of power is supplied from the start point of supply of power, and heat is generated. Thus, the time taken for reaching the target temperature is reduced compared with the configuration in which supply of power to the heater 62 is started first.

Note that the present disclosure is not limited to the above-described exemplary embodiments.

<Modification>

Figure 11:
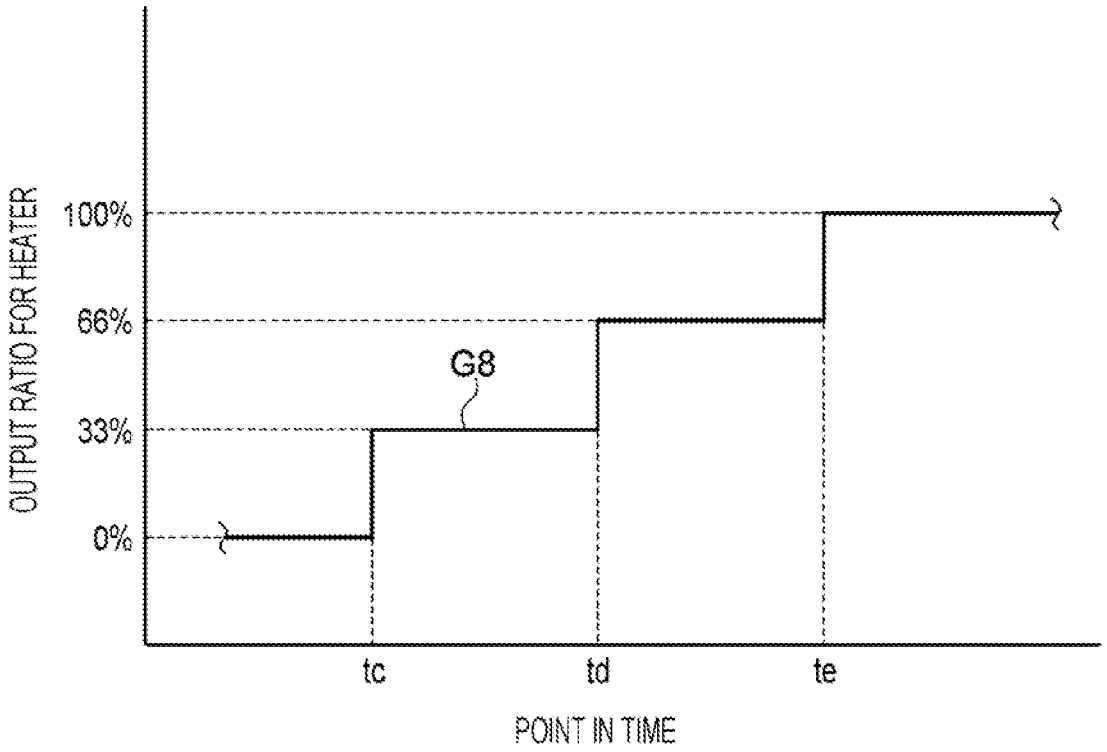
FIG. 11 is a diagram illustrating a turn on/off pattern of a heater in a fixing device according to a modification.

FIG. 11 illustrates a graph G8 as a modification of a control graph of the control power in the fixing device 30 (see FIG. 2). In the graph G8, half-value control is not performed, and when the rated power WA is 100%, the output ratio for the heater 36 is changed to 33%, 67%, and 100% in a stepwise manner. In the graph G8, the output ratio for the heater 36 is changed to 33% and then to 67% in the early period of printing. In the present modification, for example, the output ratio is changed to 33%, 67%, and 100% by changing the duty ratio between a turned-on section in which the heater 36 is in an ON state and a turned-off section in which the heater 36 is in an OFF state (by performing pulse width modulation). In this manner, even if the control power that is 33% output or 67% output is supplied to the heater 36 by using a method that does not perform the half-value control, the probability that the power supplied to the interior lighting 12 will be brought into a flickering state is reduced.

<Other Modifications>

The turn on/off pattern in the case of obtaining the 33% output by performing the half-wave control is not limited to a turn on/off pattern of ON, OFF, and OFF and may be a turn on/off pattern of OFF, ON, and OFF or a turn on/off pattern of OFF, OFF, and ON. In addition, the turn on/off pattern for obtaining the 67% output by performing the half-wave control is not limited to a turn on/off pattern of ON-ON-OFF and may be a turn on/off pattern of ON-OFF-ON or a turn on/off pattern of OFF-ON-ON.

For example, assume that a fixing device includes a heater H1 having the largest capacity W1, a heater H3 having the smallest capacity W3, and a heater H2 having a capacity W2 that is smaller than the capacity W1 of the heater H1 and larger than the capacity W3 of the heater H3. The heaters H1, H2, and H3 are each an example of a heat-generating member. Here, when a relationship of $W1<(W2+W3)$ is satisfied, the above-described control may be performed on the control power supplied to the heater H2 and the control power supplied to the heater H3, and the above-described control may not be performed on the control power supplied to the heater H1. Note that the number of the heat-generating members may be four or more.

When the sum of the control power supplied to the heater 36 and the control power supplied to the heater 62 is smaller than the rated power WA, supply of the control power to the heater 36 and supply of the control power to the heater 62 may be simultaneously started. Alternatively, supply of the control power to the heater 62 may be started before supply of the control power to the heater 36 is started.

Each of the heat-generating members is not limited to being a halogen lamp and may be a flash lamp. Note that a flickering state will become notable in the case where a halogen lamp is used.

As a measure of flicker, the above-described power supply control is not limited to being performed in the early period of printing. For example, assume the case where the first fixing operation has been completed, and the temperature of the heater 36 has decreased due to a long interval between the sheets P. In this case (an intermediate period of printing), the above-described power supply control may be performed at the start of the second fixing operation.

The method for controlling the control power supplied to the heaters 36 and 62 is not limited to the half-wave control and may be a control method using an AC waveform in which zero crossing does not occur at least one of a turn-on point and a turn-off point. In addition, the method for controlling the control power supplied to the heaters 36 and 62 is not limited to a method in which a period is changed while keeping the amplitude constant and may be a method in which the amplitude of the AC power is changed.

The present disclosure is not limited to the above-described exemplary embodiments, and various modifications and applications may be made within the gist of the present disclosure. For example, the heating device 40 is not limited to being configured to be applied to the fixing device 30.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The exemplary embodiments were chosen and described in order to best explain the principles of the disclosure and its practical applications, thereby enabling others skilled in the art to understand the disclosure for various exemplary embodiments and with the various modifications as are suited to the particular use contemplated. It is intended that the scope of the disclosure be defined by the following claims and their equivalents.

What is claimed is:

1. A heating device comprising:

a plurality of heat-generating members that generate heat by being supplied with power supplied by a shared power source; and a controller that performs control in such a manner that, when the shared power source starts supplying power to one of the plurality of heat-generating members, a rated power is supplied to the heat-generating member after power that is 33% output or 67% output of the rated power has been supplied to the heat-generating member, wherein the controller performs control in such a manner that supply of power to a heat-generating member having a larger capacity among the plurality of heat-generating members is started before supply of power to a heat-generating member having a smaller capacity among the plurality of heat-generating members when the shared power source starts supplying power to the plurality of heat-generating member.

2. The heating device according to claim 1, wherein the controller performs control in such a manner that power that is 67% output of the rated power is supplied to the heat-generating member after the 33% output power has been supplied to the heat-generating member and before the rated power is supplied to the heat-generating member.

3. The heating device according to claim 1, wherein power that is supplied to the heat-generating member by the shared power source is an alternating-current power, and wherein the controller performs thinning-out control for thinning out the alternating-current power, which is supplied to the heat-generating member, with respect to the rated power by maintaining an amplitude of the alternating-current power as the rated power and by changing a period during which the power is supplied to the heat-generating member in a period within one cycle of the alternating-current power.

4. The heating device according to claim 2, wherein power that is supplied to the heat-generating member by the shared power source is an alternating-current power, and wherein the controller performs thinning-out control for thinning out the alternating-current power, which is supplied to the heat-generating member, with respect to the rated power by maintaining an amplitude of the alternating-current power as the rated power and by changing a period during which the power is supplied to the heat-generating member in a period within one cycle of the alternating-current power.

5. The heating device according to claim 3, wherein the controller performs half-wave control with 33% output by setting, in units of a half-wavelength of the alternating-current power, which is supplied to the heat-generating member, 0.5 cycle out of 1.5 cycles to be a supply period of the alternating-current power and setting a remaining 1.0 cycle to be a non-supply period of the alternating-current power.

6. The heating device according to claim 4, wherein the controller performs half-wave control with 33% output by setting, in units of a half-wavelength of the alternating-current power, which is supplied to the heat-generating member, 0.5 cycle out of 1.5 cycles to be a supply period of the alternating-current power and setting a remaining 1.0 cycle to be a non-supply period of the alternating-current power.

7. The heating device according to claim 3, wherein the controller performs half-wave control with 67% output by setting, in units of a half-wavelength of the alternating-current power, which is supplied to the heat-generating member, 1.0 cycle out of 1.5 cycles to be a supply period of the alternating-current power and setting a remaining 0.5 cycle to be a non-supply period of the alternating-current power.

8. The heating device according to claim 4, wherein the controller performs half-wave control with 67% output by setting, in units of a half-wavelength of the alternating-current power, which is supplied to the heat-generating member, 1.0 cycle out of 1.5 cycles to be a supply period of the alternating-current power and setting a remaining 0.5 cycle to be a non-supply period of the alternating-current power.

9. The heating device according to claim 5, wherein the controller performs half-wave control with 67% output by setting, in units of a half-wavelength of the alternating-current power, which is supplied to the heat-generating member, 1.0 cycle out of 1.5 cycles to be a supply period of the alternating-current power and setting a remaining 0.5 cycle to be a non-supply period of the alternating-current power.

10. The heating device according to claim 6, wherein the controller performs half-wave control with 67% output by setting, in units of a half-wavelength of the alternating-current power, which is supplied to the heat-generating member, 1.0 cycle out of 1.5 cycles to be a supply period of the alternating-current power and setting a remaining 0.5 cycle to be a non-supply period of the alternating-current power.

11. The heating device according to claim 1, wherein the controller controls at least power that is supplied to one of the plurality of heat-generating members, the one heat-generating member having the largest capacity.

12. The heating device according to claim 2, wherein the controller controls at least power that is supplied to one of the plurality of heat-generating members, the one heat-generating member having the largest capacity.

13. The heating device according to claim 3, wherein the controller controls at least power that is supplied to one of the plurality of heat-generating members, the one heat-generating member having the largest capacity.

14. The heating device according to claim 4, wherein the controller controls at least power that is supplied to one of the plurality of heat-generating members, the one heat-generating member having the largest capacity.

15. The heating device according to claim 5, wherein the controller controls at least power that is supplied to one of the plurality of heat-generating members, the one heat-generating member having the largest capacity.

16. The heating device according to claim 6, wherein the controller controls at least power that is supplied to one of the plurality of heat-generating members, the one heat-generating member having the largest capacity.

17. The heating device according to claim 7, wherein the controller controls at least power that is supplied to one of the plurality of heat-generating members, the one heat-generating member having the largest capacity.

18. A fixing device comprising:

the heating device according to claim 1; and a fixing member that is provided with the heat-generating member and that fixes a developer image onto a recording medium while transporting the recording medium together with a pressing member.

19. An image forming apparatus comprising:

an image forming unit that forms a developer image onto a recording medium; and the fixing device according to claim 18 that fixes a developer image formed on the recording medium by the image forming unit onto the recording medium.

* * * * *